United States Patent [19]

Luke et al.

[11] 4,325,918

[45] Apr. 20, 1982

[54] DEPROTONATION OF AN ALKYLPHENYL ACID PHOSPHATE EXTRACTANT

[75] Inventors: Donald A. Luke, Seffner; Alex Magdics, Lakeland; Sandra L. Paris, Temple Terrace; Ralph E. Worthington, Winter Haven, all of Fla.

[73] Assignee: UNC Recovery Corporation, Mulberry, Fla.

[21] Appl. No.: 71,657

[22] Filed: Aug. 31, 1979

[51] Int. Cl.[3] ..... C01G 43/00; C01B 25/237

[52] U.S. Cl. ..... 423/10

[58] Field of Search ..... 423/10

[56] References Cited

U.S. PATENT DOCUMENTS 3,835,214 9/1974 Hurst et al. ..... 423/10

OTHER PUBLICATIONS

Bailes et al., "Liquid-Liquid Extraction: Metals" *Chemical Engineering,* (Aug. 30, 1976) pp. 86–94.

Deleon et al., "Possibilities for Recovery of Uranium . . .", IAEA-SM-135/39 pp, 351–361.

Hurst et al., "Recovery of Uranium from Wet-Process Phosphoric Acid . . .", Ind. Eng. Chem. Process Des. Develop. 13(3) (1974) pp. 286–291.

Hurst, "Recovery of Uranium . . .", CONF-760203-1 (1976).

*Primary Examiner*—Deborah L. Kyle

*Attorney, Agent, or Firm*—Fleit & Jacobson

[57] ABSTRACT

Uranium in wet-process phosphoric acid in the tetravalent state is extracted with an alkylphenyl acid phosphate extractant. The uranium in the pregnant extractant is then oxidized to the hexavalent state and stripped with a phosphoric acid stripping solution. Hydrolysis of the extractant is decreased by decreasing the proton concentration of the extractant which results from acidic impurities, e.g., sulfuric acid and fluorosilicic acid, originally present in the wet-process phosphoric acid. The proton concentration of the extractant is reduced indirectly by treating the phosphoric acid strip solution (1) with reagents which react with the acidic impurities to form water and an insoluble precipitate which is removed from the stripping solution; (2) with reagents to neutralize the acidic impurities in the stripping solution; or (3) by passing the stripping solution through a suitable ion exchange column.

28 Claims, 1 Drawing Figure

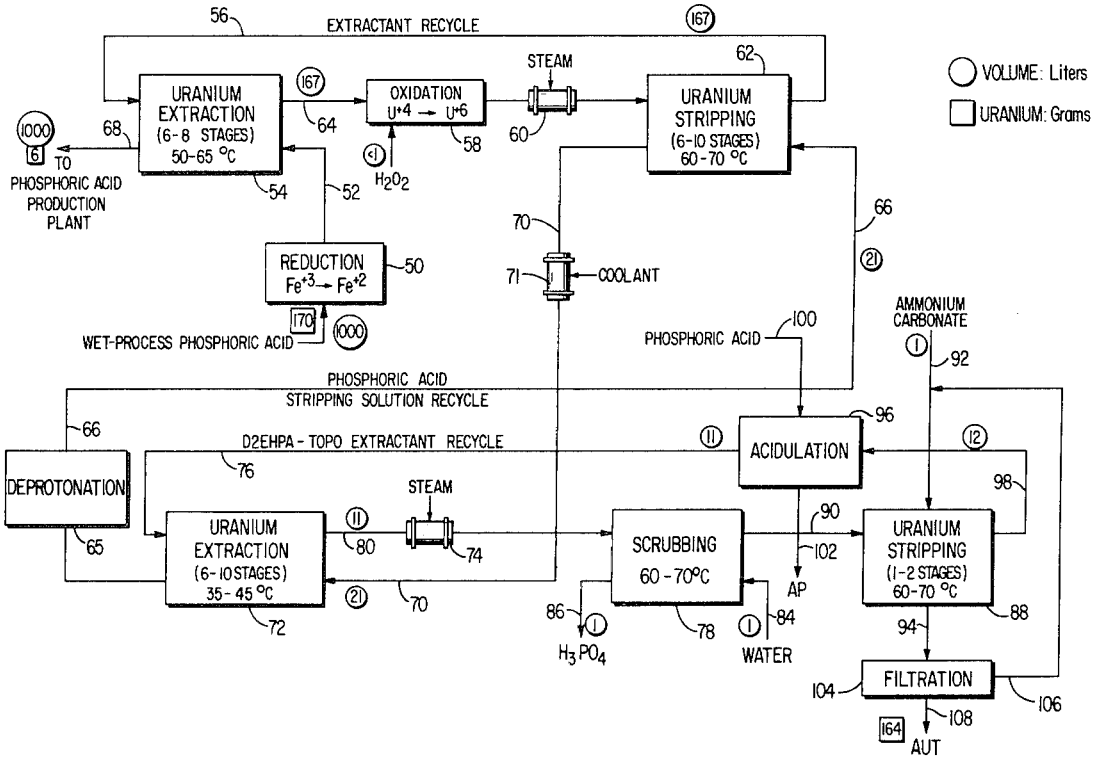

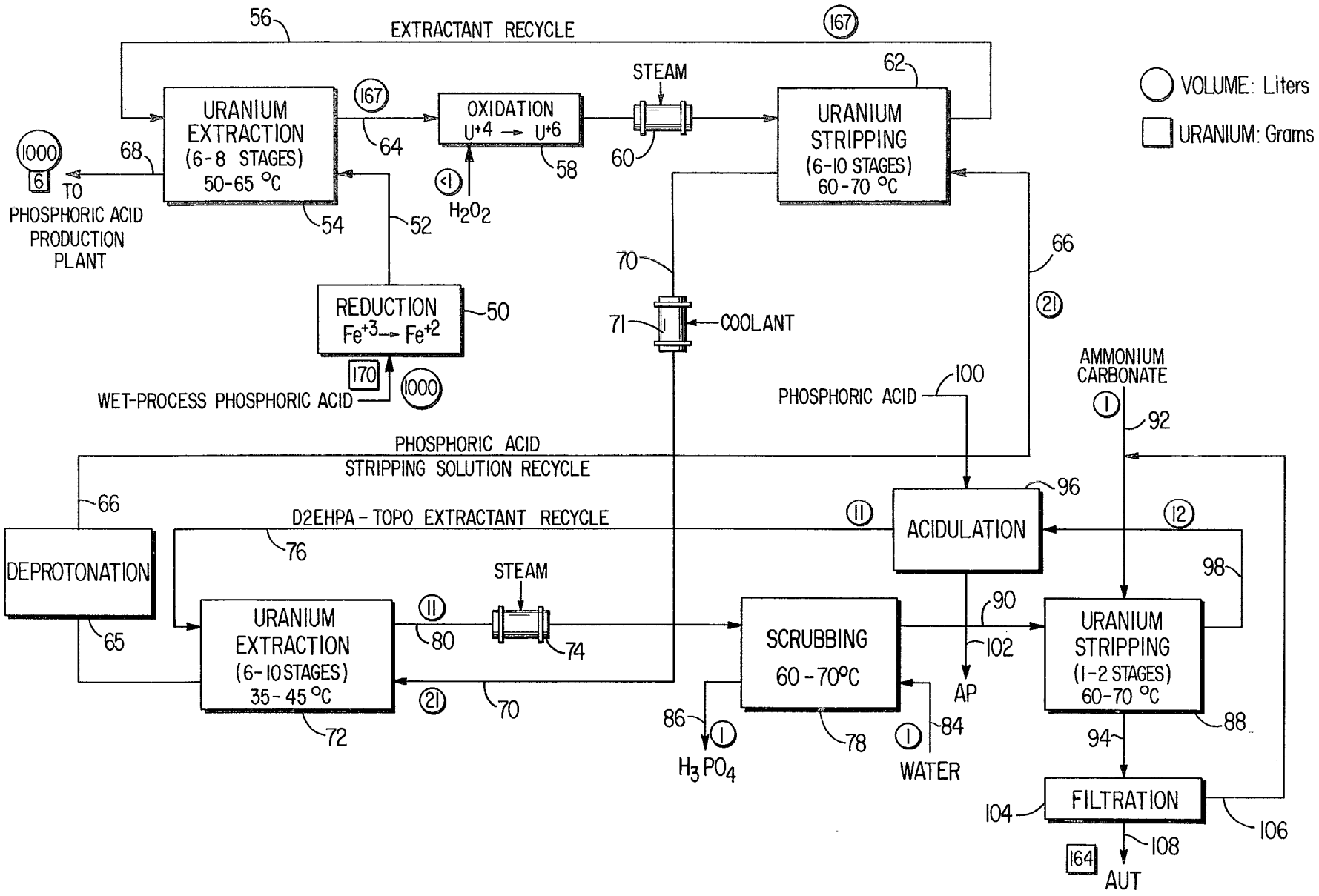
VOLUME: Liters
URANIUM: Grams
AMMONIUM CARBONATE
URANIUM STRIPPING (1-2 STAGES) 60-70 °C
FILTRATION
AUT
ACIDULATION
AP
WATER
SCRUBBING 60-70°C
$H_3PO_4$
PHOSPHORIC ACID
URANIUM STRIPPING (6-10 STAGES) 60-70 °C
COOLANT
STEAM
OXIDATION $U^{+4} \rightarrow U^{+6}$
$H_2O_2$
REDUCTION $Fe^{+3} \rightarrow Fe^{+2}$
WET-PROCESS PHOSPHORIC ACID
PHOSPHORIC ACID STRIPPING SOLUTION RECYCLE
D2EHPA-TOPO EXTRACTANT RECYCLE
EXTRACTANT RECYCLE
URANIUM EXTRACTION (6-8 STAGES) 50-65 °C
URANIUM EXTRACTION (6-10 STAGES) 35-45 °C
DEPROTONATION
TO PHOSPHORIC ACID PRODUCTION PLANT

DEPROTONATION OF AN ALKYLPHENYL ACID PHOSPHATE EXTRACTANT

BACKGROUND OF THE INVENTION

This invention relates to the recovery of uranium from phosphate compounds and, more specifically, to the recovery of uranium from phosphoric acid produced by the acidulation of phosphate rock.

Wet-process phosphoric acid is produced by digesting phosphate rock with sulfuric acid. The chemical reaction forms phosphoric acid and calcium sulfate. The latter is filtered out, providing enormous quantities of gypsum, a waste product, which leaves an impure acid stream typically containing about 30% $P_2O_5$. The impurities in the filtered acid include uranium, other metals such as ferric iron, residual sulfuric acid, and fluorosilicic acid. Most of the uranium in the original rock shows up in the 30% acid, and various extraction processes have been developed to extract this uranium. The 30% acid is generally evaporated to about 54% "merchant acid", which is either sold or used to manufacture a variety of products, chiefly fertilizers. The higher the acid concentration, the harder it is to extract the uranium. Therefore, the 30% stage is where the uranium extraction normally takes place. If the uranium is not extracted, it ends up as a minor impurity in the various end products.

A number of prior processes have been developed to recover the minor amounts of uranium contained in wet-process phosphoric acid. In many of these processes, any hexavalent uranium present in the wet-process acid is first reduced to the tetravalent state and then extracted by contacting the acid with an organic extractant which has a high extraction coefficient (Ea) for uranium in the tetravalent state. The coefficient of extraction (Ea) is a measure of the extraction power of a reagent and is defined as the ratio of the concentration of uranium in the organic phase to the concentration of uranium in the aqueous phase at equilibrium. The pregnant extractant is stripped with a suitable stripping solution, such as phosphoric acid, and the pregnant stripping solution treated to recover the uranium. For example, the pregnant stripping solution may be subjected to a second extraction step to obtain a uranium-rich extractant solution which can be further processed to recover uranium.

Alkylphenyl acid phosphate is a known organic extractant which has a high extraction coefficient for uranium in the tetravalent state. The alkylphenyl acid phosphate is formed by reacting an alkylphenol with phosphoric oxide ($P_4O_{10}$) and comprises a mixture of mono- and di-(alkylphenyl) esters of orthophosphoric acid. While this extractant is commercially available as the octylphenyl acid phosphate, and has a relatively high extraction coefficient for tetravalent uranium, the extractant has been found to hydrolyze over extended periods of use. As a result of the hydrolysis, the extraction coefficient decreases and the extractant becomes increasingly less effective in extracting uranium from wet-process acid. Accordingly, there exists a need in the art for a method to suppress the hydrolysis of the extractant and prevent its degradation.

Accordingly, it is an object of the present invention to provide a process for suppressing the hydrolysis of an alkylphenyl acid phosphate extractant.

A further object of the present invention is to provide a process for deprotonating an alkylphenyl acid phosphate extractant.

A still further object of the present invention is to provide a process for deprotonating an alkylphenyl acid phosphate extractant which is economical and minimizes the consumption of costly reagents.

Yet a further object of the present invention is to provide an efficient and economical process for recovering uranium from wet-process phosphoric acid in which uranium in the tetravalent state is extracted from wet-process acid.

SUMMARY OF THE INVENTION

We have found that the hydrolysis of an alkylphenyl acid phosphate extractant can be suppressed by controlling the proton or $H^+$ ($H_3O^+$) ion concentration in the extractant and by maintaining the proton concentration in the extractant at a relatively low level. Without being limited to the exact mechanism involved, it is believed that the hydrolysis reaction is catalyzed by protons present in the extractant and that by controlling the proton concentration in the extractant the rate of hydrolysis is materially decreased. It also has been surprisingly found that the extraction coefficient of the extractant is materially increased, rather than being maintained at a relatively constant level, by controlling the proton concentration in the extractant.

The proton concentration in the alkylphenyl acid phosphate extractant primarily results from two sources, namely, sulfuric acid and fluorosilicic acid. Both of these acids are found as impurities in wet-process acid. For example, wet-process acid typically contains about $2\frac{1}{2}$ to 4% w/v sulfuric acid and up to about 4% w/v fluorosilicic acid. During uranium recovery, these acids are carried over into the alkylphenyl acid phosphate extractant during extraction and subsequently into the stripping solution used to strip uranium from the extractant. Since both of these acids are strong acids, they readily ionize in aqueous and mixed aqueous-/organic media. Moreover, the proton concentration in the wet-process acid, the alkylphenyl acid phosphate extractant, and the stripping solution have been found in practice to be substantially the same in a continuous recycle process.

The proton concentration of the alkylphenyl acid phosphate extractant can be controlled and maintained at a relatively low level by treating the stripping solution used to strip uranium from the extractant to remove or neutralize protons contained in the stripping solution. This technique for controlling the proton concentration in the alkylphenyl acid phosphate extractant is based on the discovery discussed above that the proton concentration in the extractant is proportional to the proton concentration in the stripping solution. Therefore, the proton concentration in the extractant can be controlled indirectly by deprotonating the stripping solution. Deprotonation of the stripping solution has been found to result in two additional benefits in addition to reducing the hydrolysis of the alkylphenyl acid phosphate extractant. First, deprotonation of the stripping solution has been surprisingly found to increase the extraction coefficient of the extractant used to extract uranium from the stripping solution. Second, deprotonation of the stripping solution has surprisingly been found to decrease the entrainment of the extractant in the restripping solution which is used to re-extract uranium from the stripping solution.

The stripping solution can be deprotonated in one of several ways. For example, the deprotonation can be accomplished by (1) treating the stripping solution with reagents which react with strong acids, e.g., sulfuric acid and fluorosilicic acid, in the stripping solution to form water and an insoluble precipitate which is removed from the stripping solution; (2) treating the stripping solution with reagents which react with the strong acids in the stripping solution to form water and a soluble reaction product or chemically bind the protons associated with the strong acids into a weakly ionizable reaction product; and (3) passing the stripping solution through an ion exchange column packed with an ion exchange resin which exchanges hydroxyl ions for the anions associated with the strong acids in the stripping solution to form water. The deprotonation of the stripping solution is accomplished using reagents and ion exchange resins which do not interfere or degrade the extraction coefficient of the stripping solution.

BRIEF DESCRIPTION OF THE DRAWING

The FIGURE shows a flow sheet for an overall process for the recovery of uranium from wet-process phosphoric acid which incorporates a deprotonation treatment in accordance with the present invention.

DETAILED DESCRIPTION OF THE PREFERRED EMBODIMENTS

In accordance with the present invention, wet-process phosphoric acid which is obtained by the acidulation of phosphate rock with sulfuric acid and which typically contains about 25–35% $P_2O_5$ is preferably treated to remove solid organic materials, such as humic acids, which interfere with phase separation during uranium extraction. One method of removing the solid organic materials is described in commonly assigned U.S. Pat. No. 4,087,512. The cleaned acid is then treated with a reducing agent, such as iron or some other known reductant, so that any of the uranium in the phosphoric acid that may be in the hexavalent state is reduced to the tetravalent state and ferric iron in the phosphoric acid is reduced to the ferrous state. Since the oxidation state of the iron tends to control the oxidation state of the uranium, substantially all of the uranium in the wet-process acid will be in the reduced tetravalent state, even at relatively high ferric iron concentrations. However, to avoid ferric iron interference with extraction, the ferric iron is preferably reduced such that the ferric iron concentration in the wet-process acid is below 10 grams/liter. This reduction is typically performed in an agitated vessel, preferably in a rotating cylinder, to keep the inorganic solids suspended.

The uranium in the wet-process acid, now in the tetravalent state, is extracted with an alkylphenyl acid phosphate extractant comprising a mixture of mono- and di-(alkylphenyl) esters of orthophosphoric acid. The preferred mixed esters are prepared from commercially available octylphenol or nonylphenol. The preferred mixture is approximately an equimolar mixture of the mono- and di-esters.

The ester mixture is employed in an inert diluent. Suitable inert diluents include, for example, aliphatic hydrocarbons, aromatic hydrocarbons, aromatic petroleum fractions, and chlorinated hydrocarbons. The preferred diluents are refined high-boiling, high-flash point petroleum fractions containing 10 and 50% by volume naphthenes with the balance being principally aliphatic. The extractant solution should contain from about 10 to 30% by volume of the ester mixture. Greater than 30% by volume solutions of extractant can be used, but may result in poor phase separation. In general, the volume ratio of the wet-process acid to the extractant should be about 5 to 7:1.

In carrying out this extraction step, the mixed ester extractant and the wet-process acid are intimately mixed together and then the phases allowed to separate. This intimate intermixing may be accomplished either in a batch operation or in a continuous manner concurrently or countercurrently, with countercurrent flow being preferred. Apparatus for accomplishing intermixing and separation of two substantially immiscible phases are well-known in the art and any conventional apparatus can be used for this purpose. It is preferred to conduct the extraction in the aqueous continuous mode.

Preferably, the wet-process acid should be maintained at a temperature of about 50° to 65° C. during this extraction step, and also during the prior cleaning and reduction steps described above. By maintaining the wet-process acid at this temperature, impurities such as calcium sulfate are kept in solution which leads to less scale formation in the system and less down time for cleanout being required. After the uranium is extracted, the wet-process acid is returned to the phosphoric acid production plant.

The uranium in the pregnant mixed ester extractant is oxidized and the uranium converted from the tetravalent state to the hexavalent state in the extractant. The preferred oxidizing agent is hydrogen peroxide and is preferably added to the extractant as a 30 to 50% by volume aqueous solution. After the oxidizing agent is added, the extractant is preferably heated to approximately 60° to 70° C. to decrease the extraction coefficient and further enhance the uranium stripping.

In the next step of the process, the mixed ester extractant is stripped of its uranium content. This is accomplished by intimately contacting the extractant with a phosphoric acid stripping solution. The concentration of the stripping solution is generally between about 25 and 35% $P_2O_5$ by weight. It is preferred to use phosphoric acid prepared from elemental phosphorus produced by the direct reduction of ore in the so-called furnace process. The furnace grade or comparable acid is preferred because it is substantially free from solvents and corrosive impurities. In general, the volume ratio of the mixed ester extractant to the stripping solution should be about 6 to 10:1. As in the extraction step, the intimate intermixing of the organic and aqueous phases can be accomplished by techniques and with equipment well-known in the art, either in a batch operation or in a continuous concurrent or countercurrent operation, with the countercurrent system being preferred. Preferably, the stripping operation is accomplished in the aqueous continuous mode using conventional liquid-liquid contact techniques.

As a result of the stripping step, the uranium in the mixed ester extractant is taken up by the stripping solution. The mixed ester extractant withdrawn from the stripping apparatus, now substantially free of its uranium content, is recycled and contacted with fresh wet-process acid. The phosphoric acid stripping solution, after being separated from the mixed ester extractant, typically contains from about 5 to 10 grams of uranium in the hexavalent state per liter of strip acid. Before extracting the uranium from the stripping solution, the stripping solution is preferably cooled to about 35° to 45° C.

Uranium in the phosphoric acid stripping solution, now in its hexavalent state, is extracted with an organic extractant containing a synergistic mixture of a dialkylphosphoric acid and a trialkylphosphine oxide. The preferred dialkylphosphoric acid is di(2-ethylhexyl) acid phosphate (D2EHPA) and the preferred trialkylphosphine oxide is trioctylphosphine oxide (TOPO). The diluent for the synergistic mixture can be selected from the same class of materials as specified above for diluting the mixed ester extractant. The synergistic extractant should be approximately 0.3 to 1 M D2EHPA and 0.075 to 0.250 M TOPO, and preferably about 0.50 M D2EHPA and 0.125 M TOPO. The volume ratio of the aqueous to the organic is preferably 2 to 1:1. In carrying out this extraction step, the organic extractant containing the dialkylphosphoric acid and the trialkylphosphine oxide is intimately mixed with the phosphoric acid stripping solution. This intermixing can be accomplished either in a batch operation or in a continuous manner concurrently or countercurrently, the countercurrent system being preferred. Preferably, the intermixing should be accomplished in the aqueous continuous mode.

The pregnant synergistic extractant, after being disengaged from the barren phosphoric acid stripping solution, is preferably heated to about 60° to 70° C., scrubbed with water to remove phosphoric acid, and then stripped with an ammonium ion containing solution, preferably an aqueous ammonium carbonate solution, to form a uranium-containing stripping liquor containing, for example, ammonium uranyl tricarbonate (AUT). The ammonium carbonate solution should be at least 1.5 M, and preferably at least 2 M, to reduce the solubility of the AUT. The intermixing should be accomplished in the aqueous continuous mode for best results. The volume ratio of the aqueous to the organic phases in mixing should be about 6 to 10:1. The ammonium carbonate stripping step can be accomplished either in a batch operation or in a continuous manner concurrently or countercurrently, the countercurrent system being preferred. After filtration and washing, the uranium precipitate can be decomposed thermally to yield a high-grade $U_3O_8$ product.

The phosphoric acid stripping solution is deprotonated either before or after the uranium in the stripping solution is extracted with the dialkylphosphoric acid and trialkylphosphine oxide extractant. If the deprotonation is accomplished by treating the stripping solution with reagents which react to form an insoluble precipitate, the barren stripping solution rather than the pregnant stripping solution is preferably deprotonated. Since the barren stripping solution contains a low uranium concentration, uranium is not removed with the precipitated solids which would require an additional step to recover the uranium. If the deprotonation is accomplished by passing the stripping solution through an ion exchange column, either the barren or pregnant stripping solution can be passed through the ion exchange column, although it is still preferred to treat the barren stripping solution. By deprotonating the stripping solution, hydrolysis of the mixed ester extractant is suppressed and reduced to as little as one-third its normal rate. Also, it has been found in practice that the extraction coefficient of the mixed ester extractant is increased by as much as 50%. Additional benefits which are derived from the deprotonation of the stripping solution include nearly 100% improvement in the extraction coefficient of the dialkylphosphoric acid and trialkylphosphine oxide extractant and up to a 90% reduction in the amount of dialkylphosphoric acid and trialkylphosphine oxide extractant entrained in the stripping solution.

The phosphoric acid stripping solution can be deprotonated by treating the stripping solution with reagents which react with strong acids, e.g., sulfuric acid and fluorosilicic acid, in the stripping solution to form water and an insoluble precipitate which is removed from the stripping solution. The particular reagent selected should not be reactive with phosphoric acid at the concentration of reagent employed. Otherwise, the extraction coefficient of the phosphoric acid stripping solution would be degraded. Reagents which have been found to be useful include alkali metal and alkaline earth metal compounds since these compounds will selectively react with the sulfuric acid and fluorosilicic acid found in the phosphoric acid stripping solution. Examples of suitable alkali metal compounds are alkali metal phosphates such as trisodium phosphate ($Na_3PO_4.12H_2O$), alkali metal carbonates such as sodium carbonate and alkali metal hydroxides such as sodium hydroxide. Trisodium phosphate, for example, will react with fluorosilicic acid to form an insoluble precipitate ($Na_2SiF_6$), water, and phosphoric acid, a neutral product which will not interfere with the phosphoric acid stripping solution. Examples of useful alkaline earth metal compounds are alkaline earth metal hydroxides such as calcium hydroxide, preferably hydrated lime ($Ca(OH)_2$), and alkaline earth metal carbonates such as calcium carbonate. Calcium hydroxide, for example, will react with sulfuric acid to form an insoluble precipitate ($CaSO_4$) and water.

It is generally preferred to add a stoichiometric excess of the reagent used to form the insoluble product to ensure that the product is sufficiently insoluble that it can be conveniently removed from the phosphoric acid stripping solution by filtration or the like. It also is preferred to treat the entire stream of the phosphoric acid stripping solution with the reagent. It has been found that if a stoichiometric excess of the reagent is employed to treat the phosphoric acid stripping solution during the first cycle of a continuous recycle process, excess reagent is not required during second and subsequent cycles. It is generally preferred to employ about two times the stoichiometric quantity of reagent required to form the insoluble product during the first cycle and to employ a stoichiometric quantity of the reagent during second and subsequent cycles. For example, if an alkali metal compound such as trisodium phosphate is employed to react with the fluorosilicic acid to form an insoluble product, $1\frac{1}{2}$ moles of trisodium phosphate are employed during the first cycle per mole of fluorosilicic acid. Then, during second and subsequent cycles $\frac{2}{3}$ mole of trisodium phosphate can be employed, namely, a stoichiometric addition. If an alkaline earth metal compound such as hydrated lime is employed to react with the sulfuric acid present in the stripping solution, 2 moles of hydrated lime are employed per mole of sulfuric acid during the first cycle to ensure two times the stoichiometric quantity necessary to react with the sulfuric acid. During the second and subsequent cycles, 1 mole of hydrated lime are employed since only a stoichiometric addition is necessary.

When forming an insoluble product, the phosphoric acid stripping solution is treated in a conventional corrosion-resistant vessel. The reaction time necessary to accomplish this deprotonation step is based on the time required for crystal growth and the formation of the insoluble product. The reaction time may be as long as three hours, although 30 minutes to 1½ hours is generally sufficient. The temperature of the deprotonation step is not critical. For example, the deprotonation step can be conducted at the normal temperature of the barren stripping solution, namely, about 35° to 45° C. or, if the pregnant stripping solution is deprotonated, at the normal temperature of the pregnant stripping solution prior to cr after cooling. While the deprotonation temperature may range over wide limits from the freezing point to the boiling point of the stripping solution, it will be understood that the deprotonation step is normally conducted at the temperature of the phosphoric acid stripping solution being treated to avoid the added cost of heating or cooling the stripping solution.

A second method of deprotonating the phosphoric acid stripping solution is to treat the stripping solution with reagents which react with the strong acids, e.g., sulfuric acid and fluorosilicic acid, in the stripping solution to form water and a soluble reaction product or chemically bind the protons associated with the strong acids into a weakly ionizable reaction product. In this method, as in the previously described method, the particular reagent selected should not be reactive with phosphoric acid at the concentration of reagent employed. This method is less preferred than the previously described method in which insoluble products are formed along with the release of water since the reaction products are soluble and remain in the phosphoric acid stripping solution during recycling. Suitable reagents include compounds such as ammonia and organic bases. With respect to the quantity of reagents and other process conditions, these are essentially the same as those discussed with respect to the use of the reagent which forms an insoluble precipitate.

A third method of deprotonating the phosphoric acid stripping solution is to pass the stripping solution through an ion exchange column. In this method, the stripping solution is preferably passed through an ion exchange column packed with an ion exchange resin ($OH^-$ form) which will combine with the anions of the strong acids present in the stripping solution (e.g., $SO_4^=$ and $SiF_6^=$) and form water. Ion exchange resins suitable for this purpose are well-known in the art. Examples of useful classes of ion exchange resins include acrylic resins, polystyrene resins, and phenolic resins. It should be understood that one or more ion exchange columns will be employed depending upon the selectivity of the particular ion exchange resin employed in each column and the anions with which the particular resin will combine. Since ion exchange resins are temperature sensitive, a relatively low temperature up to about 50° C. will normally be employed. Since the barren phosphoric acid stripping solution and the pregnant phosphoric acid stripping solution after cooling are at approximately 35° to 45° C., the phosphoric acid stripping solution can normally be passed through the ion exchange column without temperature adjustment. The ion exchange resin is regenerated when necessary by conventional techniques.

In order to facilitate an easier understanding of the present invention, a flow sheet illustrating the process is provided in the FIGURE. Wet-process phosphoric acid, preferably treated to remove a substantial portion of its solid organic material content as described in U.S. Pat. No. 4,087,510, is introduced into reduction unit 50. The wet-process acid, now containing uranium primarily in the tetravalent state and impurities such as iron primarily in reduced oxidation states, is introduced via line 52 into countercurrent uranium extraction unit 54 having 6 to 8 stages, while alkylphenyl acid phosphate extractant comprising a mixture of mono- and di-(octyl- or nonylphenyl) acid phosphate in an inert diluent is introduced into the unit via recycle line 56. After extraction, the extractant, now rich in uranium, is oxidized in oxidation unit 58, heated in heat exchanger 60 and then introduced into countercurrent uranium stripping unit 62 having 6 to 10 stages via line 64, while phosphoric acid is introduced into the unit via recycle line 66. Extracted wet-process acid is removed from the uranium recovery system via line 68 and returned to the phosphoric acid production plant to be evaporated to 54% "merchant acid". After being stripped of its uranium content, the mixed ester extractant from uranium stripping unit 62 is recycled to uranium extraction unit 54 via recycle line 56.

Uranium-rich stripping solution from uranium stripping unit 62, now containing uranium in the hexavalent state, is cooled in heat exchanger 71 and introduced via line 70 into countercurrent uranium extraction unit 72 having 6 to 10 stages. An organic extractant comprising di-(2-ethylhexyl) phosphoric acid (D2EHPA) and trioctyl phosphine oxide (TOPO) in an inert diluent is fed to uranium extraction unit 72 via recycle line 76.

Barren phosphoric acid stripping solution from uranium extraction unit 72 is fed to deprotonation unit 65 and then recycled to uranium stripping unit 62 via recycle line 66. In deprotonation unit 65, the phosphoric acid stripping solution is treated with one or more reagents described above to reduce the proton concentration in the stripping solution which is associated with acids stronger than phosphoric acid. Alternatively, the deprotonation unit 65 can comprise an ion exchange column packed with suitable ion exchange resins to reduce the proton concentration in the stripping solution. Since the proton concentration in the stripping solution is reduced, on recycle of the barren stripping solution to uranium stripping unit 62, additional strong acids such as sulfuric acid and fluorosilicic acid will transfer to the stripping solution thereby reducing the proton concentration of the mixed ester extractant and suppressing hydrolysis of the mixed ester extractant.

After extraction, the D2EPHA/TOPO extractant, now rich in uranium, is heated in heat exchanger 74 and then introduced into scrubbing unit 78 via line 80. Water is introduced into scrubbing unit 78 via line 84 and phosphoric acid removed from scrubbing unit 78 via line 86. Phosphate-free D2EHPA/TOPO extractant from scrubbing unit 78 is introduced into uranium stripping unit 88 having one or two stages via line 90. Also introduced into uranium stripping unit 88 is an aqueous ammonium carbonate solution via line 92. Stripped D2EHPA/TOPO extractant from uranium stripping unit 88 is introduced into a one-stage acidulation unit 96 via line 98. Also introduced into acidulation unit 96 is phosphoric acid via line 100. Ammonium phosphate (AP) made in unit 96 is withdrawn from the unit via line 102. Acidulated D2EHPA/TOPO extractant is recycled to uranium extraction unit 72 via recycle line 76. Uranium-containing stripping liquor, typically comprising ammonium uranyl tricarbonate (AUT) is removed from the uranium stripping unit 88 via line 94 and fed to the filtration unit 104. The filtrate from the filtration unit 104 is recycled to uranium stripping unit 88 via lines 106 and 92. The precipitate is removed from filtration unit 104 via line 108 and can be decomposed thermally to a high-grade $U_3O_8$ product.

To facilitate an understanding of the advantages and operation of the present invention, the following examples are provided to illustrate the deprotonation step of the present invention. Also, to further facilitate an understanding of the over-all uranium recovery process, typical relative volume flows and uranium concentrations are shown in the FIGURE enclosed in circles and squares, respectively.

EXAMPLE 1

Reagent grade phosphoric acid (30% $P_2O_5$) stripping solution which had contacted a pregnant extractant comprising an equimolar mixture of mono- and di-octyl phenyl phosphate ester in kerosene and contained 14.1 g/l total fluoride ion comprising principally fluorosilicic acid and 25.4 g/l sulfate ion comprising principally sulfuric acid was treated at ambient temperature with 46.6 g/l (2×stoichiometric) trisodium phosphate dodecahydrate. The mixture was stirred for one hour and then 39.2 g/l (2×stoichiometric) of calcium hydroxide was added. After stirring for a further hour, the mixture was filtered and the filtrate shown to contain 3.6 g/l total fluoride and 8.1 g/l sulfate ion.

EXAMPLE 2

Reagent grade phosphoric acid (30% $P_2O_5$) stripping solution which had contacted a pregnant extractant comprising an equimolar mixture of mono- and di-octyl phenyl phosphate ester in kerosene and contained 14.25 g/l total fluoride ion comprising principally fluorosilicic acid and 24.96 g/l sulfate ion comprising principally sulfuric acid was treated with 0.22 lb/gal of trisodium phosphate anhydrous to precipitate sodium fluorosilicate and then 0.15 lb/gal of calcium hydroxide to precipitate calcium sulfate. After stirring for one and one-half hours, the solids were removed by filtration and the treated strip acid was measured to contain 2.3 g/l total fluoride and 6.2 g/l sulfate ion. The acid was recontacted with pregnant extractant and was shown to contain 2.4 g/l total fluoride and 13.9 g/l sulfate ion, after contact. This acid was processed with only 0.11 lb/gal calcium hydroxide to yield deprotonated acid containing 2.4 g/l total fluoride and 6.04 g/l sulfate ion. Before treatment of the strip acid, a 15% w/v solution of the equimolar mixture of mono- and di-octyl phenyl phosphate ester in kerosene was hydrolyzing at a rate equivalent to 0.1% reduction in ester concentration/day, i.e., about 15.0%/day. Deprotonation of the strip acid reduced this hydrolysis rate to 0.03%/day.

EXAMPLE 3

A continuous experiment was run using a 2" glass column packed with approximately 500 grams of ion exchange resin comprising a phenolic based polyfunctional amine sold under the tradename Duolite A-7 by Diamond Shamrock Co. Reagent grade phosphoric acid (30% $P_2O_5$) stripping solution which had contacted a pregnant extractant comprising an equimolar mixture of mono- and di-octyl phenyl phosphate in kerosene and contained approximately 12 g/l hydrofluorosilicic acid (expressed as fluoride) and approximately 10 g/l sulfuric acid was fed to the ion exchange column. The deprotonated acid contained approximately 6.0 g/l hydrofluorosilicic acid (expressed as fluoride) and approximately 7.0 g/l sulfuric acid. The depleted resin was washed with a 20% solution ammonium hydroxide to remove the acids present on the resin. The feed ammonium hydroxide contained no hydrofluorosilicic or sulfuric acid. The output ammonium hydroxide contained approximately 16.0 g/l hydrofluorosilicic acid (expressed as fluoride) and approximately 23.0 g/l of sulfuric acid.

As will be readily understood by those of ordinary skill in the art, minor modifications may be made in the invention described above without in any way departing from the spirit and scope of the invention. Accordingly, it is understood that the invention will not be limited to the exact details disclosed hereinbefore, but will be defined in accordance with the appended claims.

We claim:

1. In a process for recovering uranium from wet-process phosphoric acid comprising extracting uranium into an alkylphenyl acid phosphate extractant in which acidic impurities in the wet-process phosphoric acid are transferred to the extractant resulting in hydrolysis of the extractant, the improvement comprising decreasing the proton concentration of said extractant resulting from said acidic impurities whereby said hydrolysis of said extractant is decreased.

2. In a process of recovering uranium from wet-process phosphoric acid comprising extracting the uranium into an alkylphenyl acid phosphate extractant and then stripping the uranium into a phosphoric acid stripping solution in which the alkylphenyl acid phosphate extractant is hydrolyzed, the improvement comprising treating said phosphoric acid stripping solution to decrease the proton concentration of said stripping solution resulting from acidic impurities originally present in said wet-process phosphoric acid whereby said hydrolysis of said extractant is decreased.

3. The process of claim 2 wherein the alkylphenyl acid phosphate extractant comprises a mixture of mono- and di-(octylphenyl) esters of phosphoric acid in an organic diluent.

4. The process of claim 3 wherein the stripping solution is treated with reagents which react with the acidic impurities to form water and an insoluble precipitate.

5. The process of claim 4 wherein the reagents are selected from the group consisting of alkali metal compounds and alkaline earth metal compounds.

6. The process of claim 5 wherein the reagents are selected from the group consisting of trisodium phosphate and calcium hydroxide.

7. The process of claim 6 wherein the acidic impurities include sulfuric acid and fluorosilicic acid and at least about 1 mole of calcium hydroxide is used per mole of sulfuric acid and at least about $\frac{2}{3}$ mole of trisodium phosphate is used per mole of fluorosilicic acid present in the stripping solution.

8. The process of claim 3 wherein the stripping solution is treated with a basic solution to neutralize the acidic impurities.

9. The process of claim 8 wherein the basic solution is selected from the group consisting of ammonia and organic bases.

10. The process of claim 3 wherein the stripping solution is contacted with an ion exchange resin to decrease the proton concentration.

11. A process of recovering uranium from wet-process phosphoric acid, comprising:

(a) extracting the uranium from the wet-process phosphoric acid into a first extractant comprising a mixture of mono- and di-(alkylphenyl) esters of orthophosphoric acid dissolved in an organic diluent;

(b) stripping the uranium from the first extractant into a phosphoric acid stripping solution;

(c) extracting the uranium from the stripping solution into a second extractant;

(d) treating the phosphoric acid stripping solution to decrease the $H^+$ ion concentration associated with strong acid impurities contained therein; and (e) recycling the stripping solution to step (b).

12. The process of claim 11 wherein the first extractant comprises a mixture of mono- and di-(octylphenyl) esters of phosphoric acid.

13. The process of claim 12 wherein in step (d) the stripping solution is treated with reagents which react the strong acid impurities to form water and an insoluble precipitate.

14. The process of claim 13 wherein the reagents are selected from the group consisting of alkali metal compounds and alkaline earth metal compounds.

15. The process of claim 14 wherein the reagents are selected from the group consisting of trisodium phosphate and calcium hydroxide.

16. The process of claim 15 wherein the strong acid impurities include sulfuric acid and fluorosilicic acid and at least about 1 mole of calcium hydroxide is used per mole of sulfuric acid and at least about $\frac{2}{3}$ mole of trisodium phosphate is used per mole of fluorosilicic acid present in the stripping solution.

17. The process of claim 12 wherein in step (d) the stripping solution is treated with a basic solution to neutralize the acidic impurities.

18. The process of claim 17 wherein the basic solution is selected from the group consisting of ammonia and organic bases.

19. The process of claim 12 wherein step (d) comprises contacting the stripping solution with ion exchange resin to decrease the $H^+$ ion concentration.

20. The process of claim 12 wherein the stripping solution is treated to decrease the $H^+$ ion concentration and then recycled to step (b).

21. A process of recovering uranium from wet-process phosphoric acid, comprising:

(a) extracting the uranium from the wet-process phosphoric acid into a first organic extractant comprising a mixture of mono- and di-(alkylphenyl) esters of orthophosphoric acid in an organic diluent;

(b) oxidizing the uranium in the uranium-rich first organic extractant to the hexavalent state;

(c) contacting the extractant obtained in (b) with a phosphoric acid stripping solution to strip the hexavalent uranium into the phosphoric acid stripping solution;

(d) contacting the phosphoric acid stripping solution containing the hexavalent uranium with a second organic extractant comprising a mixture of a dialkylphosphoric acid and a trialkylphosphine oxide in an organic diluent to extract the hexavalent uranium into the second organic extractant;

(e) treating the barren stripping solution obtained in (d) to decrease the $H^+$ ion concentration associated with strong acid impurities contained therein;

(f) recycling the treated stripping solution obtained in (e) to (c); and (g) recovering the uranium from the second organic extractant.

22. The process of claim 21 wherein the first organic extractant comprises a mixture of mono- and di-(octylphenyl) esters of orthophosphoric acid.

23. The process of claim 22 wherein in step (e) the barren stripping solution is treated with reagents which react with the strong acid impurities to form water and an insoluble precipitate.

24. The process of claim 23 wherein the reagents are selected from the group consisting of calcium hydroxide and trisodium phosphate.

25. The process of claim 24 wherein the strong acid impurities include sulfuric acid and fluorosilicic acid and at least about 1 mole of calcium hydroxide is used per mole of sulfuric acid and at least about 1 mole of trisodium phosphate is used per mole of fluorosilicic acid contained in the stripping solution.

26. The process of claim 22 wherein in step (e) the barren stripping solution is treated with a basic solution to neutralize the strong acid impurities contained therein.

27. The process of claim 26 wherein the basic solution is selected from the group consisting of ammonia and organic bases.

28. The process of claim 22 wherein in step (e) the barren stripping solution is contacted with an ion exchange resin to decrease the $H^+$ ion concentration.

* * * * *